United States Patent [19]

Gorton et al.

[11] 4,086,747

[45] May 2, 1978

[54] HEADSET DEVICE FOR A CAPPING MACHINE

[75] Inventors: Philip S. Gorton, Richland, Wash.; Ronald K. Coleman, Columbus, Ohio

[73] Assignee: Aluminum Company of America, Alcoa Center, Pa.

[21] Appl. No.: 793,360

[22] Filed: May 5, 1977

[51] Int. Cl.[2] ..... B67B 3/18; B65B 7/28

[52] U.S. Cl. ..... 53/340

[58] Field of Search ..... 53/334, 338, 340, 351, 53/352, 353

[56] References Cited

U.S. PATENT DOCUMENTS

| | | | |
|---|---|---|---|
| 1,674,266 | 6/1928 | Sharp | 53/340 |
| 2,372,138 | 3/1945 | Underwood | 53/351 X |
| 3,760,561 | 9/1973 | Over et al. | 53/338 X |
| 3,895,478 | 7/1975 | Friendship | 53/334 X |

*Primary Examiner*—Othell M. Simpson
*Assistant Examiner*—Horace M. Culver
*Attorney, Agent, or Firm*—Teare, Teare & Sammon

[57] ABSTRACT

A headset device for use with a capping machine for applying roll-on closures to a container, wherein a plurality of capping headsets is provided, each of which includes pivotally mounted cam roller and follower members operative in response to reciprocal movement of a cone-like cam member in conjunction with a resilient torsion element for generating a predetermined controlled radial force on the metal forming roller members upon axial displacement of the cam member.

11 Claims, 5 Drawing Figures

HEADSET DEVICE FOR A CAPPING MACHINE

BACKGROUND OF THE INVENTION

The present invention relates generally to a headset device for use with the capping machine of the type for applying roll-on closures to a container, and more particularly relates to an improved construction of a headset device which includes a plurality of roll-on mechanisms which are applied under a predetermined, controlled radial force for deforming the closure upon axial displacement of a cone-like cam member.

For many years, capping machines have been in use for applying rool-on closures of the type wherein the skirt of a closure has threads or impressions formed in it by deformation of the skirt against a finish on a container mouth. One kind of roll-on capping machine comprises a rotatable turret and vertically movable capping spindles wherein top pressure is applied against the closures on containers to develop a top seal and/or a side seal, and spinning headsets, including thread rollers on the spindles, move against the closures and rotate around the closures to form threads in the skirts, as described in U.S. Pat. No. 3,303,955. For example, a headset for applying 28 millimeter beverage closures with locking bands (pilferproof ring) preferably includes two each of the thread and band rollers, as described in U.S. Pat. No. 3,760,561.

Heretofore, various types of headset arrangements have been provided for applying closure members operating on the roll-on method. For example, cam operating arrangements have been employed which directly actuate the cam rollers so that there is little or no tolerance for variations in the container dimensions. In addition, improper adjustment of such arrangements may occasionally produce slits in the closure skirt, broken or damaged containers (particularly glass containers) and/or may result in poor thread formation. Recently, a headset device has been employed which utilizes a pneumatic spring arrangement which can be adjusted by regulating the air pressure so as to accommodate the various size containers formed of different materials having different resistance to pressure, as described in U.S. Pat. No. 3,895,478.

Accordingly, in such headset devices the principal problem encountered results from the necessity of having to insure that the roll-on mechanisms acting on the closure perform with the most desirable pressure for the work to be carried out. For example, the radial force employed must be sufficient to form the metal of the roll-on closure to the bottle finish but not excessive enough to cause damage to the closure (shear, swedge, etc.) or bottle finish (spall, fracture, craze, etc.). Insufficient radial force results in a shallow-thread formation. The shallow thread is detrimental principally because (1) objectionably high torques are required by the consumer to twist the shallow-thread closure off the bottle, (2) the pressure containment capability of the shallow-thread closures is inadequate to contain products packaged under pressure, (3) upon a marginally shallow-thread closure subjected to an increase in contained pressure, the closure seals can fail suddenly often blowing the closure from the bottle as an uncontrolled projectile. Accordingly, it is desirable to provide an improved headset which minimizes the problems encountered in prior apparatus and methods for applying roll-on closures.

SUMMARY OF THE INVENTION

The invention provides an improved construction for a headset device for use with a capping machine of a type for applying roll-on closures to a container which provides a controlled radial force for deformably securing the closure around the mouth of a container upon axial displacement of a cone-like cam member.

Accordingly, an object of the invention is to provide a novel and improved construction for a headset device which is readily adapted for use with a roll-on capping machine, and which is adapted to receive an accessory plug cam for removal and installation of the headset device from the capping machine with a minimum of time and effort.

Another object of the invention is to provide a headset device which includes a plurality of thread and/or band rollers which are resiliently pivoted into forming engagement with a closure by a pre-loaded torsion force elememt, which produces a controlled metal forming force on the closure, and is moved out of forming engagement upon axial displacement of a cone-like cam member which slidably coacts with cam follower rollers.

A further object of the invention is to provide such a type of headset device which may be employed with a plug cam so as to lock a plurality of such torque-generating mechanisms in the open position for removal from or installation in a capping machine, and for ready storage and handling.

BRIEF DESCRIPTION OF THE DRAWINGS

The above and other objects and advantages of the invention will be more fully understood and appreciated with reference to the following description and the drawings appended hereto wherein.

DESCRIPTION OF A PREFERRED EMBODIMENT

Figure 1:
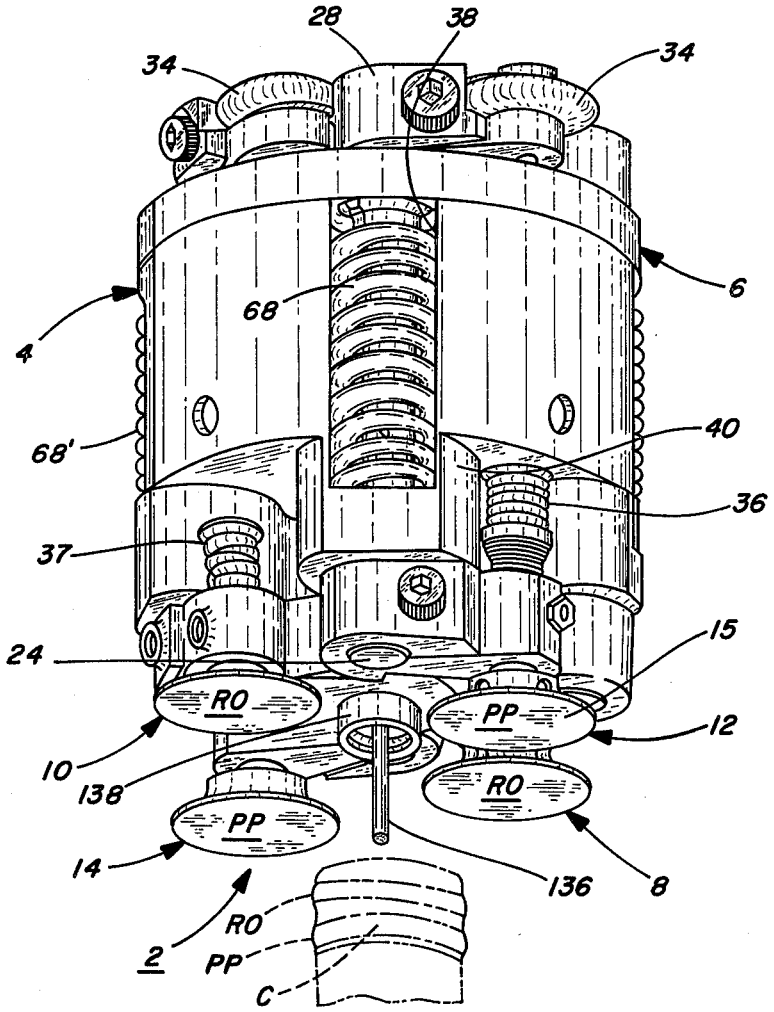
FIG. 1 is a generally perspective view of a headset device adapted for use with a roll-on spindle in a capping machine for applying roll-on closures.

Referring to FIG. 1, a headset device, designated generally at 2, is illustrated for rolling the thread portions RO and also a pilfer-proof ring PP in the skirt of a closure C (dotted line). One type of roll-on capping machine, or capper, with which the present improved headset device may be employed is described in U.S. Pat. No. 3,760,561. For example, the headset device 2 of the invention may be attached to the drive sleeve 120 (FIG. 4) which may be secured to one of a series of spindles 90 of a capping machine. Moreover, during capping, the drive sleeve 120 may be rotated for spinning the present headset device 2, as will be described hereinafter:

In the present invention, any number of headset devices 2 may be employed, dependent upon the number of spindles employed with the particular capping machine. As employed herein, the term "headset" means a spinning headset which rotates around a closure to deform it against a container B, as shown best in FIG. 4.

In the embodiment illustrated, the headset device 2 comprises a hub-like housing 4 which may be of a two-part casting to facilitate assembly of the torque-generating subassemblies. To the housing 4 is bolted or otherwise mounted a housing cap 6 to facilitate mounting of the cam-follower subassembly. In the invention, the housing 4 mounts a plurality (four) of independent torque-generating subsystems to support and actuate a pair of opposed roll-on mechanisms (RO) 8 and 10 and a pair of pilfer-proof mechanisms (PP) 12 and 14 angularly disposed at 90° with respect to one another so as to provide an oppositely disposed paired relationship in respect to the vertical longitudinal central axis of the housing 4. A headset for applying closures with no locking band (pilfer ring) does not require band or pilfer-proof roll-on mechanism.

In the invention, the roll-on and pilfer-proof mechanisms 8, 10, 12 and 14 are substantially of identical construction. Hence, only one thereof will be described, corresponding parts of the others being indicated where necessary by the same numerals with the prime designation. As best seen in FIG. 1, the mechanism 12 selected for illustration essentially comprises a roller 15 which may be mounted in a roller bushing (not shown). The bushing is mounted in a hole 16 (FIG. 3) in a pivot arm member 18 in such a manner that the roller 15 is free to rotate when in contact with a non-rotating surface, such as the surface of a closure skirt. The pivot arm 18 is provided with another hole 22 adapted to receive a pivot shaft 24 for securement thereto upon tightening of a fastener 26, such as a screw or the like. To the other end of the pivot shaft 24 is attached a cam follower arm 28 ( FIG. 3) via hole 30 and fastener 32, such as a screw or the like. A cam roller 34 is attached for free rotation to the cam follower arm 28 for riding engagement on the cone-cam member 20. The thread roller 10 has a resilient spring 37 on the end thereof through the pivot arm 18 for resiliently mounting the roller to accommodate small variations in the vertical height of the finish of the container, and to enable the roller to follow the thread helix on the container.

Figures 3, 5:
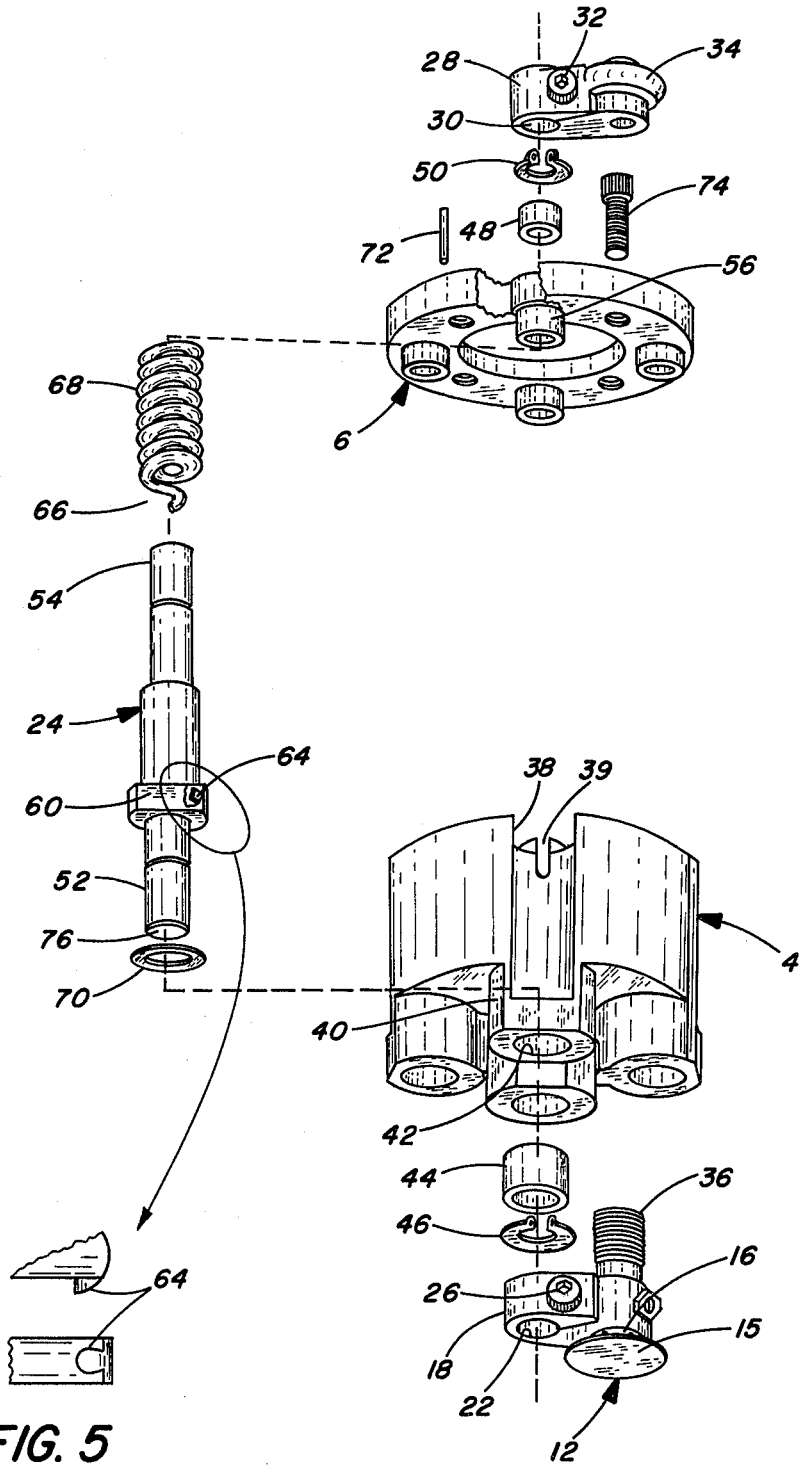
FIG. 3 is a generally perspective assembly view of the headset device made in accordance with the present invention.
FIG. 5 is a top elevation view and a side elevation view of the pinion on the integral shoulder of the pivot shaft shown in FIG. 3.

In accordance with the invention, each roller subsystem is mounted on the housing 4 via its respective pivot shaft, as at 24, to provide a controlled radial force from the spring 68 (FIG. 3) which engages the roller 15 against a closure to deformably secure it on a container. Again referring to mechanism 12, the housing 4 is provided with a cylindrical recess slot 38 which opens onto the outer surface of the housing, as best seen in FIG. 1. An integral collar or hub 40 having a bore 42 receives the lower end 52 of the pivot shaft 24 in a bearing sleeve 44 (FIG. 3). A retainer ring 46 secures the pivot shaft 24 in the hub 40. A similar bearing 48 and retainer ring 50 may also be provided for the other end of pivot shaft 24 for rotatably securing the shaft in the housing cap 6.

As best seen in FIG. 3, the pivot shaft 24 has a lower end 52 adapted to be inserted through the bore 42 in the hub 40 and an upper end portion 54 adapted to be received through a sleeve 56 machined in or assembled on the housing cap 6. The pivot shaft 24 is provided between its upper and lower ends with an integral shoulder 60 provided with a pinion 64. The hook-end, as at 66, of a torsion spring 68 is radiused such that it is adapted to fit matingly around the pinion 64 when the spring 68 is disposed axially around the pivot shaft 24. Elevation views of the pinion 64 are shown in FIG. 5. In FIG. 1, the pinion 64 and hook-end 66 of the spring 68 are toward the housing and therefore not seen. Once assembled, a thrust washer 70 seats against the confronting undersurface of the hub 40 which provides the bearing support. The other end of the spring 69 has a radially extending hook (not shown) thereon which is disposed in a slot 39 (FIG. 3) machined in the confronting interior surface of the housing 4. Upon manufacture or assembly of the housing cap 6, the bearing sleeve 56 is disposed around the upper end portion 54 of the pivot shaft 24 so as to be encompassed by the torsion spring 68. Suitable dowel pins, as at 72, in conjunction with machine screws, as at 74, may be employed for mounting the housing cap 6 to the housing 4.

In the invention, the roller arm end of each pivot shaft 24 (FIG. 3) may be provided, as at 76, with a hex-head socket (not shown) to facilitate wind-up of the torsion spring 68 to the desired pre-load torque level. The torsion spring is of a relatively low spring rate, such as 0.4 to 0.5 inch pounds of torque per degree of pivotal rotation. The pre-load torque level such as 45 to 50 inch pounds of torque is determined in relation to the desired radial force required to activate the rollers of the respective roll-on mechanims 8, 10, 12 and 14. Hence, the radial force must be sufficient to form the metal of the closure to the bottle finish, but not excessive enough to cause damage to the closure (shear, swedge, etc.) or bottle finish (spall, factor, craze, etc.)

As previously noted, the cam rollers 34 of each assembly are disposed for coacting engagement in respect to the outer confronting surface of the cone-cam member 20. The cone-cam 20 may be operably mounted on a roll-on spindle 90 (FIG. 4) of a turret assembly, designated generally at 92. In general, the turret assembly 92 is mounted on a capper base 94 which includes a support sleeve 96 and a drive sleeve 98 for rotating the turret frame 100 with the roll-on spindles 90 therein during capping. The center support column 102 of the turret assembly extends through the support sleeve 98 and is fixedly secured and positioned in the support sleeve by suitable means (not shown). A turret support sleeve 104 and an upper support 106 are secured on the upper end of the support column 102, and are secured to the column by means of a key or other locking means (not shown). Lower cam 108 is secured to the support sleeve 104, and an upper cam 110 is secured to the upper support 106. As the turret support sleeve, upper support and two cams are secured to the center column 102 which does not rotate, these parts also do not rotate. The turret hub 112, turret frame 100, with spindles mounted therein, and planetary gear support 114 are secured to the drive sleeve 98 which does rotate. Accordingly, when the drive sleeve 98 is driven, support 114, turret frame 100 and the spindles therein are rotated around the center support column 102 and rotated, with respect to stationary cams 108 and 110, and cam tracks 116 and 118, in the cams.

For purposes of illustration, a roll-on spindle has been illustrated which is adapted to apply closures of a well-known kind to containers B, wherein threads are formed in the closure skirt and a bottom edge portion, as illustrated in FIG. 1.

As shown, the spindle 90 further includes a drive sleeve 120 with a driven gear 112 secured thereto, mounted on head pressure shaft 124 below housing 126 so that the gear can freely rotate on the shaft, and a slide 128 over drive sleeve 120 with a cam follower 130 attached to the upper end of the slide and the cone-cam 20. During capping, the gear 122 is continually rotated by drive means (not shown) which, in turn, rotates the drive sleeve 120 for spinning the headsets attached to the sleeve. More specifically, upon vertical reciprocation of the slide 128, the cone-cam member 20 of the present invention is moved vertically which, in turn, and in cooperation with the torsion spring 68, moves the cam rollers 34 in and out with respect to the longitudinal central axis of the headset 2 so as to pivot the thread rollers 8 and 10 in and out via the pivot arms 18. Accordingly, as the spindles are rotated around the turret, the respective roll-on mechanisms 8, 10, 12 and 14 are pivoted in and out against the skirt of the container B and rotated around the closure to roll the threads in the closure skirt and to turn the lower edge of the locking band on the closure around its entire circumference, as specifically illustrated and described in U.S. Pat. No. 3,760,561.

Figure 4:
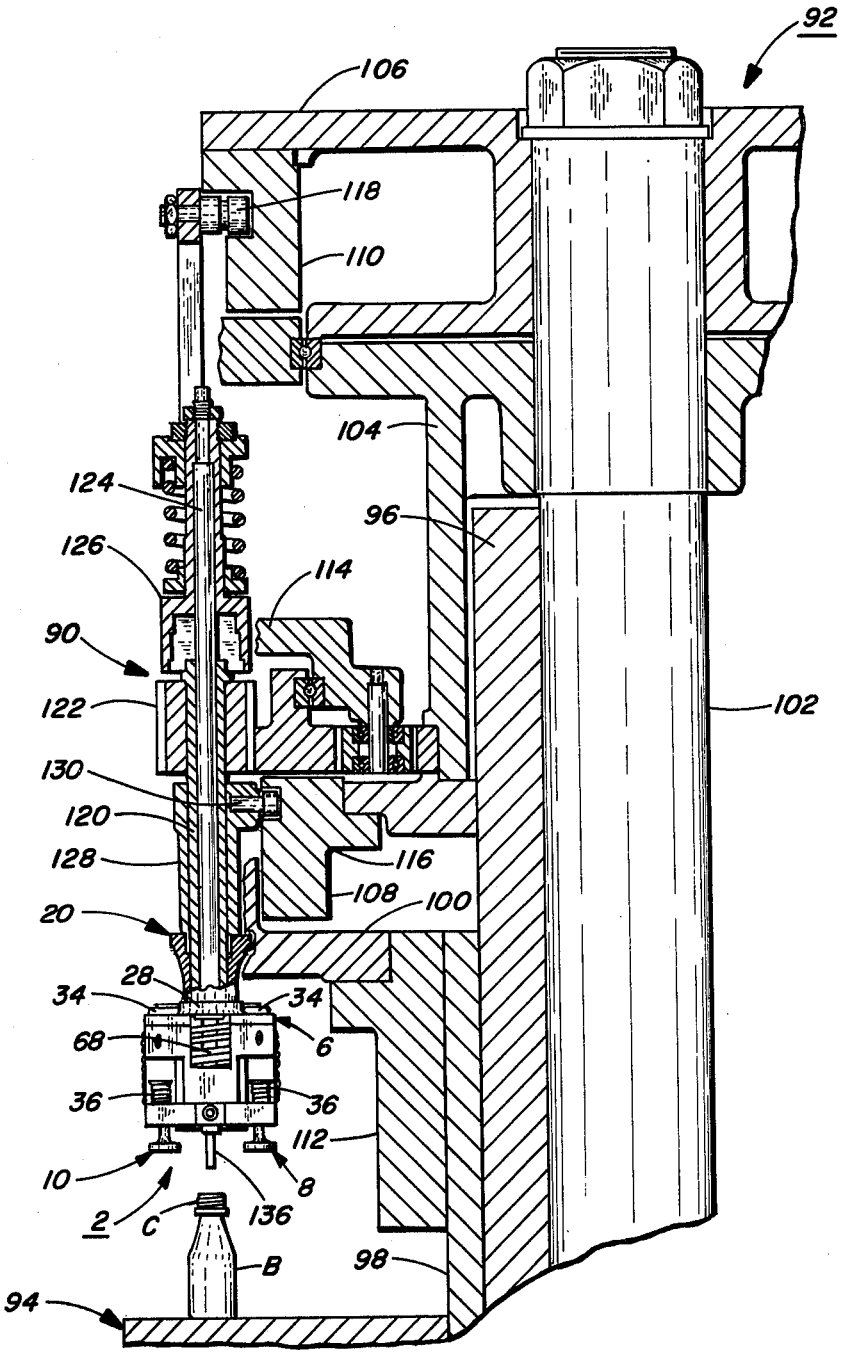
FIG. 4 is a partial cross-sectional view of a turret of the type which may be employed for use with the headset device of the invention, and illustrating a roll-on spindle in one of the vertical slots in the spindle.

As best seen in FIGS. 1 and 4, the bottom end of the shaft 124 has a pressure block 138 mounted on it and may include a plunger 136 resiliently mounted by means of a spring (not shown) for holding the closure on the container B. The pressure block 138 may also include a closure stripper or knock-out which is not shown.

Figure 2:
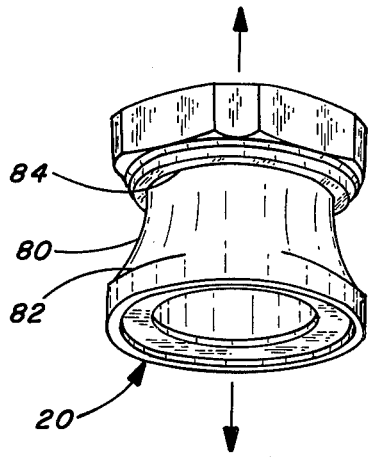
FIG. 2 is a generally perspective view of a cone-cam made in accordance with the present invention.

In the invention, the cone-cam 20 has a frustoconical cam surface 80 which tapers inwardly and upwardly toward a smaller diameter in a direction away from the headset 2, as illustrated in FIGS. 1 and 2. The surface 80 is defined by a major diameter as at 82, and a minor diameter, as at 84, which define therebetween the conical configuration shown. Upon assembly, the cam follower arms 28 are clamped on the pre-loaded pivot shaft 24 with the followers 34 seated against the major cone-cam diameter 82. The pre-load torque provided by the torsion spring 68 is specified at the open lower position with the cam rollers 34 being disposed on this major diameter. The roller arms 18 are then assembled on the pivot shaft 24 and positioned with the rollers 15 against an "open position" plug gauge to provide the predetermined pre-load torque for actuating the roll-on mechanism. Preferably, in the closed forming position of the roll-on mechanisms, the cam rollers 34 slide on the non-rotatable, cam surface 80 in a direction away from the major diameter 82 and in a direction inwardly toward the minor diameter 84. In order to provide an optimum controlled radial force upon reciprocal displacement of the cone-cam member 20, the cam rollers 34 are maintained out of contact with the minor diameter 84 of the cone-cam surface 80. Thus, the controlled forming force results entirely from the pre-load of the torsion spring to a predetermined torque level, as for example 45 to 50 inch pounds. Due to the relatively low spring rate to typically 0.4 to 0.5 inch pounds per degree of pivot, variations in the closure and container diameters and forming roller displacement during closure deformation do not appreciably affect the applied radial forming force.

In operation, the cam rollers 34 roll on the outer surface 80 of the cone-cam 20 with the cone attached to sleeve 128 which is vertically reciprocated according to the movement of the cam followers 129, 130 in cam tracks 116, 118 (FIG. 4). This vertical movement of the cone-cam 20, cams rollers 34 in and out via the conical surface 80 with respect to the axis of the spindle 90. This pivots roll-on mechanisms 8, 10, 12 and 14 in and out relative to the axis of the spindle 90. Accordingly, as spindles 90 are rotated around turret 92, the rollers 15 of the roll-on and pilfer-proof mechanisms are pivoted in and out against the skirt of closure C and rotated around the closure to roll threads in the closure skirt and turn a lower edge of a locking band on the closure around its entire circumference. Suitable driving means (not shown) may be provided so that a headset 2 will be rotated a sufficient number of rotations about the axis of the spindle 90 on which it is mounted in each revolution of the turret 92 on its axis in order to insure that the complete circumference of a closure skirt will be deformed against a container finish during the rolling operation, as more specifically set forth in U.S. Pat. No. 3,760,561. After the closure C has been affixed to the container B, the sleeve 120 is reciprocated upwardly along with the cone-cam 20 which pivots the mechanisms 8, 10, 12 and 14 outwardly and away from the closure skirt, whereupon the entire spindle is raised off the sealed container. Accordingly, all of the spindles 90 on a turret are moved around the turret, and each spindle applies a closure to a container during each revolution of the turret. Moreover, with 20 spindles, 20 containers can be closed during each revolution of the turret, as described in Pat. 3,760,561.

Accordingly, the present invention provides a plurality of independent, torque-generating subsystems, including thread and/or band rollers which are resiliently pivoted into forming engagement with the closure in response to a pre-loaded torsion spring which maintains a controlled metal forming force on the closure C. Axial displacement of a cone-cam slidably coacts with the cam follower means to pivot the forming rollers outwardly after deformation of a closure. Importantly, it will be recognized that the present invention provides a torsion spring which acts to generate a controlled radial force in respect to the closure upon reciprocal movement (axial displacement) of the cone-cam. The torsion spring element provides sufficient force of the forming roller against a closure to form the metal of the closure to the bottle finish but not excessive force to cause damage to the closure or bottle finish.

While the invention has been desribed in terms of a preferred embodiment, the claims appended hereto are intended to encompass all embodiments which fall within the spirit of the invention.

Having thus described our invention and a certain embodiment thereof, we claim:

1. A headset device of the type for use with a capping machine for securing closures on containers comprising:

a housing adapted to be supported on a spindle of a capping machine;

a pivot shaft disposed for rotational movement in said housing;

roller means and a cam follower means pivotally mounted on said pivot shaft;

cam means adapted to be mounted for axial movement on said spindle for pivotally actuating said cam follower means and said roller means radially outward; and resilient torsion means disposed for operable coaction between said housing and said roller means for generating a predetermined radial inward force on said roller means for deformably securing a closure on a container.

2. A headset device in accordance with claim 1, including:

first pivot arm means for pivotally mounting said roller means for radial in and out movement relative to the longitudinal central axis of said cam means, and second pivot arm means for pivotally mounting said cam follower means for radial in and out movement relative to the longitudinal central axis of said cam means.

3. A headset device is accordance with claim 1, wherein:

said roller and cam follower means are attached adjacent the opposed ends of said pivot shaft; and a torsion spring member is disposed around said pivot shaft and adapted to be attached at one end to said housing and at the other end is adapted for engagement with abutment means on said pivot shaft so as to be resiliently pre-loaded upon rotation of said pivot shaft.

4. A headset device in accordance with claim 3, including:

first pivot arm means fixedly attaching said roller means adjacent one end of said pivot shaft; and second pivot arm means fixedly attaching said cam follower means adjacent the other end of said pivot shaft.

5. A headset device in accordance with claim 1, wherein:

said cam means includes a cone-like cam member having a generally frusto-conical cam surface adapted for sliding engagement with said cam follower means upon axial movement thereof; and said cam surface tapering radially inwardly in a direction away from said headset.

6. A headset device in accordance with claim 5, wherein:

said cam surface includes a major diameter adapted to contact said cam roller means in the open position thereof; and a minor diameter adapted to be moved toward said cam follower means in the generally closed forming position of said roller means.

7. A headset device in accordance with claim 1, wherein:

said pivot shaft is disposed vertically in said housing for rotational movement about a vertical axis;

first pivot arm means fixedly attaches said roller means to one end of said pivot shaft;

second pivot arm means fixedly attaches said cam follower means to the opposed end of said pivot shaft; and said first and second pivot arm members extend radially outwardly in generally the same direction away from said pivot shaft.

8. A headset device in accordance with claim 7, including resilient spring means operably coacting between said first pivot arm means and said housing for resiliently biasing said roller means relative to said housing.

9. A headset device in accordance with claim 1, including two thread forming roller means and two pilfer-proof roller means mounted in said housing.

10. A headset device for securing closures on containers comprising:

a housing;

a pivot shaft disposed for rotational movement in said housing;

first and second pivot arm means attaching a roller means and a cam follower means at opposite ends of said pivot shaft;

resilient torsion spring means disposed around said pivot shaft for generating a predetermined radially inward force on said roller means in response to pre-load force on said pivot shaft for deformably securing a closure on a container; and cam means adapted for camming coacting engagement with said cam follower means for pivoting said roller means outwardly upon axial displacement of radial cam means.

11. A headset in accordance with claim 10, including two thread forming roller means and two pilfer-proof roller means mounted in said housing.

* * * * *